US008122525B2

(12) United States Patent
Getz

(10) Patent No.: US 8,122,525 B2
(45) Date of Patent: Feb. 28, 2012

(54) PUTTING-GREEN, IN-POOL SURFACE CONSTRUCTION

(76) Inventor: Jeffery L. Getz, Phoenix, AZ (US)

( * ) Notice: Subject to any disclaimer, the term of this patent is extended or adjusted under 35 U.S.C. 154(b) by 468 days.

(21) Appl. No.: 12/197,196

(22) Filed: Aug. 22, 2008

(65) Prior Publication Data

US 2009/0100588 A1 Apr. 23, 2009

Related U.S. Application Data

(60) Provisional application No. 60/957,438, filed on Aug. 22, 2007.

(51) Int. Cl.
*E04H 4/00* (2006.01)

(52) U.S. Cl. ..... 4/403; 4/496; 4/498; 4/661

(58) Field of Classification Search ..... 4/503, 496, 4/495, 498, 494

See application file for complete search history.

(56) References Cited

U.S. PATENT DOCUMENTS 4,229,004 A * 10/1980 Stokes ..... 473/3
2002/0000069 A1* 1/2002 McNamara ..... 52/66
2003/0073506 A1* 4/2003 Coplien ..... 473/157
2007/0220666 A1* 9/2007 Diarte ..... 4/498
2008/0016611 A1* 1/2008 Khalaf et al. ..... 4/498
2008/0282460 A1* 11/2008 Del Valle ..... 4/498

FOREIGN PATENT DOCUMENTS

GB 2187772 A * 9/1987

* cited by examiner

*Primary Examiner* — Gregory Huson
*Assistant Examiner* — Karen L Younkins
(74) *Attorney, Agent, or Firm* — Barbara J. Luther; The Luther Law Firm, PLC

(57) ABSTRACT

A putting green whose perimeter is level with the top of a concrete-sided pool having a decorative ribbon along the top of the pool side and an apron surrounding the pool having at least partially flat surface, the putting green overlying a deck including a) a waterproof surface comprising decking surface members having lengths and ends, the lengths being sized to the dimensions of the pool and the surface being at the same level as the pool apron; b) supports including i. cross members which are perpendicular to the lengths of the decking surface members; ii. underlying joists that form a sturdy base for the cross members; and iii. joist hangers being secured to the sides of the pool below the decorative ribbon along the top of the pool side and being sunk into the concrete side of the pool; and c) a putting green comprising at least the layers of gravel, sand and artificial grass.

1 Claim, 13 Drawing Sheets

PUTTING-GREEN, IN-POOL SURFACE CONSTRUCTION

TECHNICAL FIELD

Embodiments of the invention relate generally to decks and their construction methods. More particularly, the embodiments of the invention relate to a pool-covering putting green over deck apparatus and method of construction.

BACKGROUND

In the warmer climates, many homes are equipped with outdoor in-ground pools formed from poured concrete. Such pools are often free form, such as the classic kidney shape, rather than the rectangular form preferred for exercise and competition. These swimming pools are usually surrounded by concrete decks which are level with the edge of the pools.

In addition, many pools are equipped with a decorative ribbon around the inside upper edge of the pool for easier cleaning and for a decorative effect. Such an edge can be textured concrete, plaster, or tiles.

Homeowners change their minds about the desire for a pool. Sometimes the children who used the pool have grown and no longer reside in the home. Other times, grandchildren appear on the scene and need to be protected from a swimming pool. New homeowners may purchase the home for its indoor characteristics and do not want the outdoor pool. The responsibility for the pool (problems of others gaining access and harming themselves) may weigh heavily on the homeowner.

Pool maintenance and upkeep include electricity to circulate the water and cleaning devices, chemicals to kill algae and maintain the proper salt balance and pH, water replacement, pool cleaning components such as hoses, pool maintenance charges by contractors, insurance and pool replastering. Current estimates for pool maintenance and upkeep are estimated at about $2,000 per year. Closing off an unwanted pool can save the homeowner significant funds in a few years.

There are few alternatives for getting rid of the pool. Often pools are filled in, often with the concrete deck that surrounded the pool, and landscaped over. Occasionally people will simply ignore the pool until it turns green, but then it may harbor obnoxious mosquitoes and pose a health hazard. If the pool is filled in with concrete, it cannot be used again because it is extremely difficult to dig out the concrete; replacing the pool is prohibitively expensive. A new pool must be added to a different, less convenient part of the home's yard.

What is needed is a stricture that can be worked into the existing landscape plan without seriously damaging the swimming pool and permitting it to be "revived" at a later date. Ideally such a structure would be added to completely cover the pool, permitting no-one, even small animals from entering the pool. Preferably the structure would be attached to the pool so as to avoid damaging the expensive decorative ribbon around the top edge of the pool. Moreover, because concrete in-ground pools are built in a myriad of shapes and the structure covering the pool needs to be in a unique shape, there needs to be an efficient way to cut the wood deck members to their proper size and close tolerance with the pool dimensions. Even more useful would be a putting green over the deck structure for the pool-owner to enjoy a new outdoor activity.

SUMMARY OF INVENTION

In one embodiment, there is provided a putting green whose perimeter is level with the top of a concrete-sided pool having a decorative ribbon along the top of the pool side and an apron surrounding the pool having at least partially flat surface, the putting green overlying a deck including a) a waterproof surface comprising decking surface members having lengths and ends, the lengths being sized to the dimensions of the pool and the surface being at the same level as the pool apron; b) supports including i. cross members which are perpendicular to the lengths of the decking surface members; ii. underlying joists that form a sturdy base for the cross members; and iii. joist hangers being secured to the sides of the pool below the decorative ribbon along the top of the pool side and being sunk into the concrete side of the pool; and c) a putting green comprising at least the layers of gravel, sand and artificial grass.

In another embodiment of the pool covering structure in accordance with the present invention, a side-mounted beam rests on a pre-existing pool step or pool seat if such has been formed as part of the pool and is at a correct height to accommodate a beam and a beam mount. Where this approach to supporting a beam is used, the beam mount includes pressure treated wood to rest on the pool floor and then the beam rests on the pressure treated wood. The beam is held in place by the rigidity of the structure held together on the top of the beam.

In the following detailed description of the preferred embodiments, reference is made to the accompanying drawings that form a part hereof, and in which are shown by way of illustrating specific embodiments in which the invention may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of present inventions. The following detailed description, therefore, is not to be taken in a limiting sense, and the scope of various embodiments of the invention is defined only by the appended claims, along with the full range of equivalents to which such claims are entitled.

DETAILED DESCRIPTION OF INVENTION

The current invention incorporates unique features which offer benefits appreciated by the owner of a pool. First of all, the deck is installed in a new configuration, such that the deck contact with the side of the pool is below the decorative rim around the pool. This gives the pool deck a semi-permanence, such that the structure can be removed at a later date, and the pool be returned to working status with a minimum of plastering repair and cost. The plastering is performed mostly below the filled water line. The new plastering is thus less visible when the pool is in use. Thus, replastering can be performed quickly. Were the deck structure installed in the usual manner (higher on the pool wall), the decorative tile rim would be damaged, requiring expensive replacement and delays in returning the pool to service.

The structures described below can be assembled and installed for a modest investment, having a payback time of less than four years (taking into account the pool maintenance costs mentioned above).

The embodiments described below are built to normal building standards for floors and decks and usually far exceed structural requirements. In fact, most exceed commercial requirements for floor loading. If one desires to put even heavier loads on the deck, the deck can be easily reinforced for increased loads.

Figure 1:
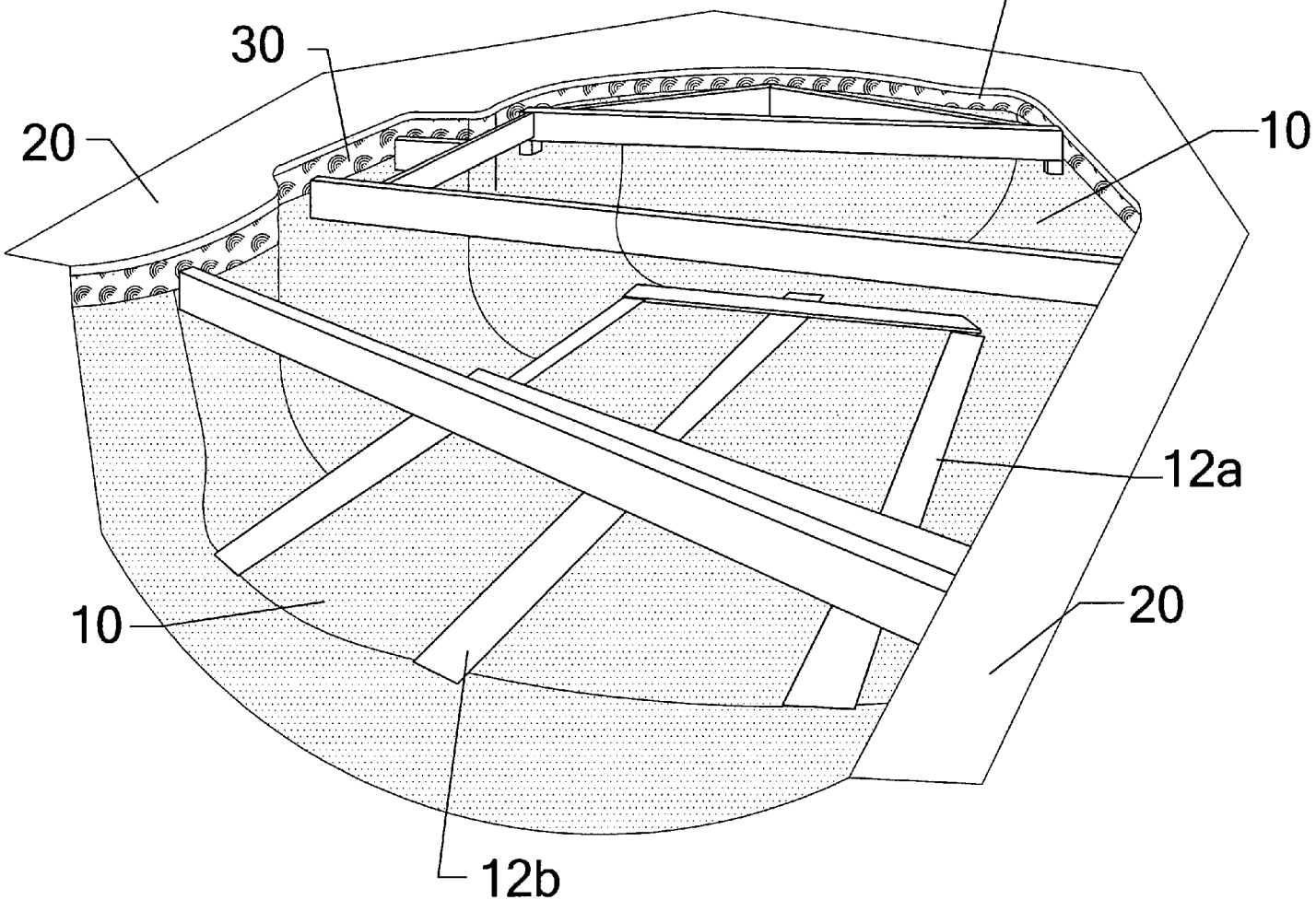
FIG. 1 is a perspective view of a deck being built to cover a swimming pool. Note that boards have been placed in the bottom of the pool for moving across bottom of pool.

FIG. 1 shows an empty pool 10 in which several boards 12*a*, 12*b*, etc. have been placed for workers to walk during construction. This too limits damage to the pool surface and makes easier the rehabilitation of the pool. Such boards 12*a*, etc., are preferably left in the pool after construction and can support objects to be stored under the pool cover. Another advantage of the embodiments described below is that there is accessible space under the deck cover for storage of waterproof objects, such as kayaks, old pool equipment, plastic storage boxes, etc.

Figure 2:
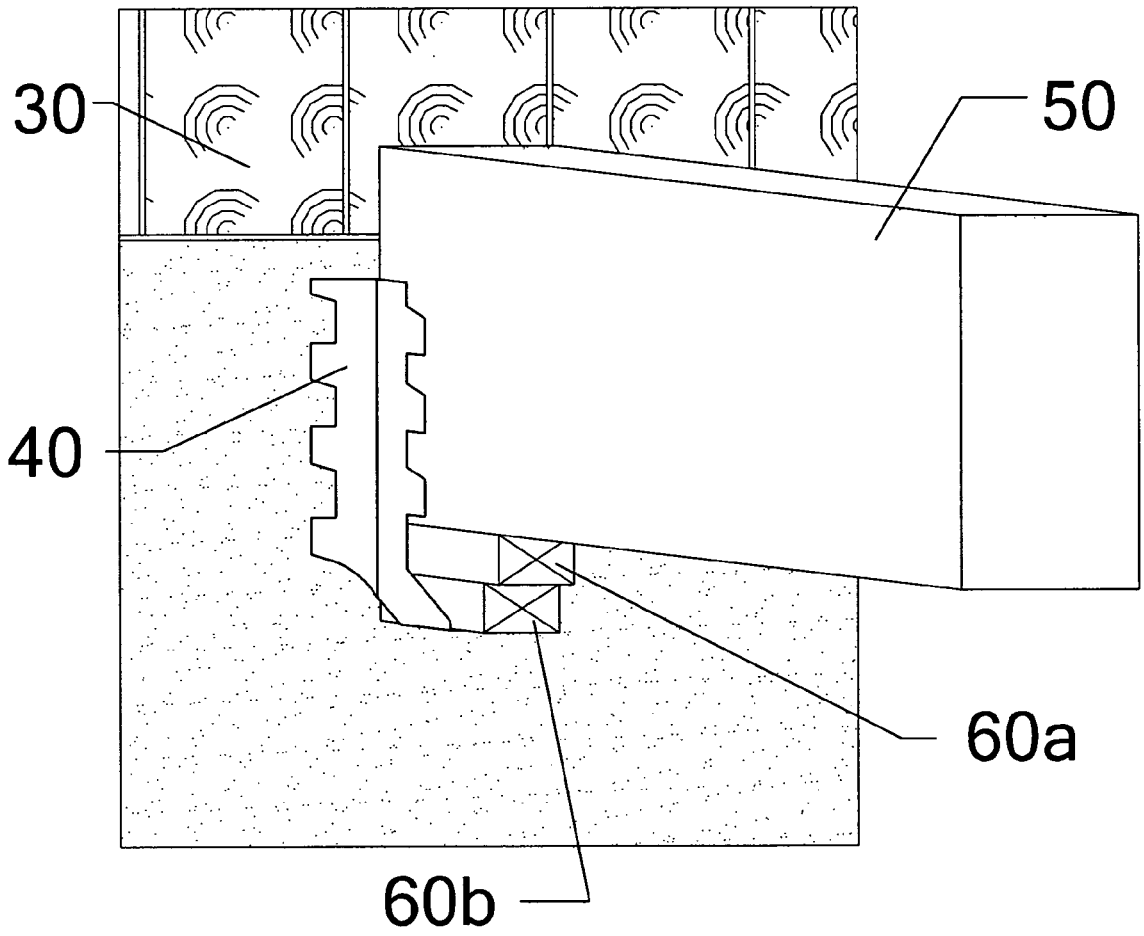
FIG. 2 is a perspective view of a swimming pool wall on which a joist hanger has been installed below the decorative stripe around the pool. The joist hanger contains a joist and blocks to shim the joist.
Figure 3:
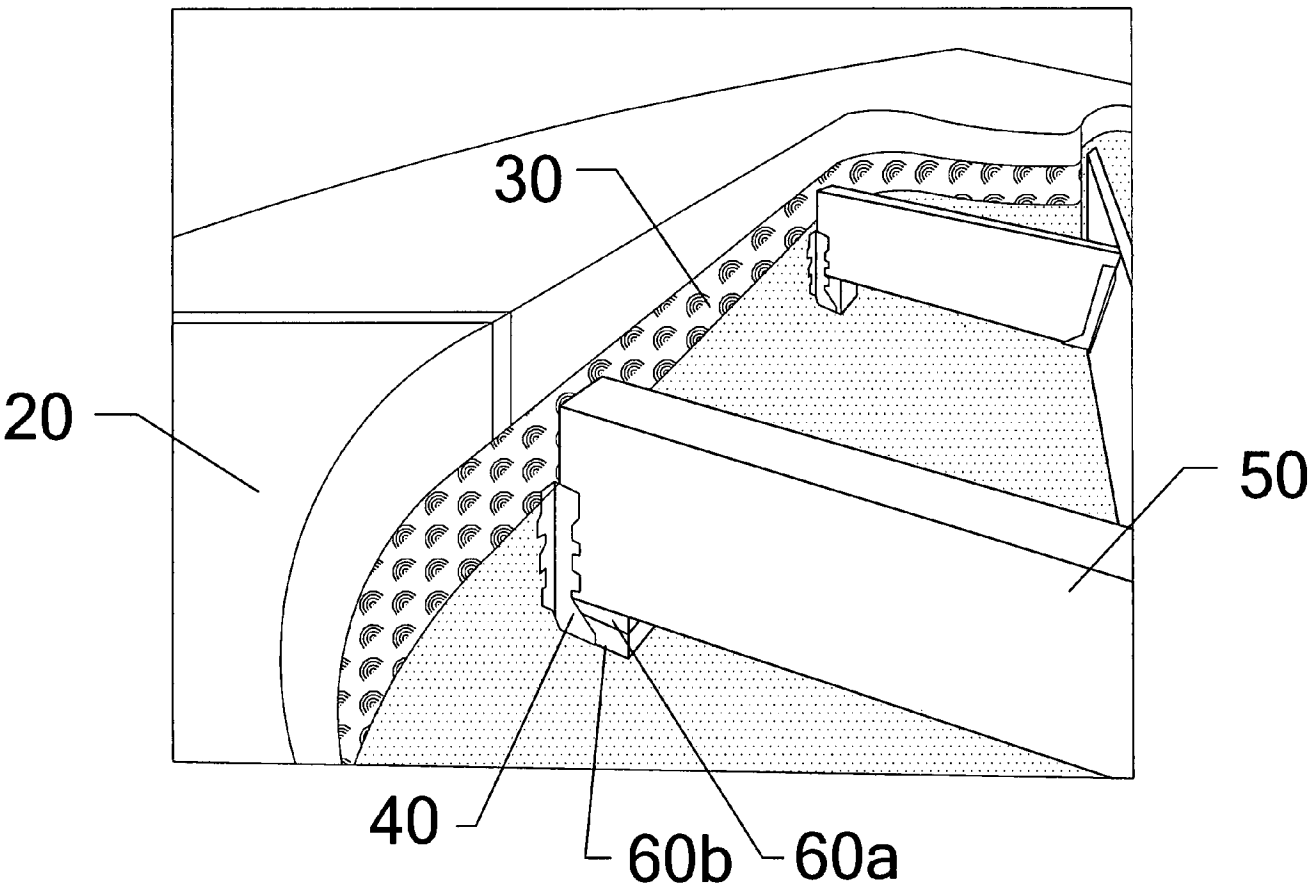
FIG. 3 is another perspective view of a swimming pool wall with decorative tile around its edge and joist hanger installed below the decorative tile and joists being installed

FIGS. 2 and 3 show the locations of bolts 40 being placed into the pool side. Note the joist hanger 40 location is below the decorative tile rim 30 of the pool. The joists 50 are placed in these joist hangers 40 and form the base for the pool structure. The joists 50 are shimmed up with blocks 60*a*, 60*b*, to raise the deck structure above the concrete apron 20. The blocks 60*a*, 60 B, etc. are removed when deck structure (see below) is completed and lowered to concrete apron 20 level.

Figure 4:
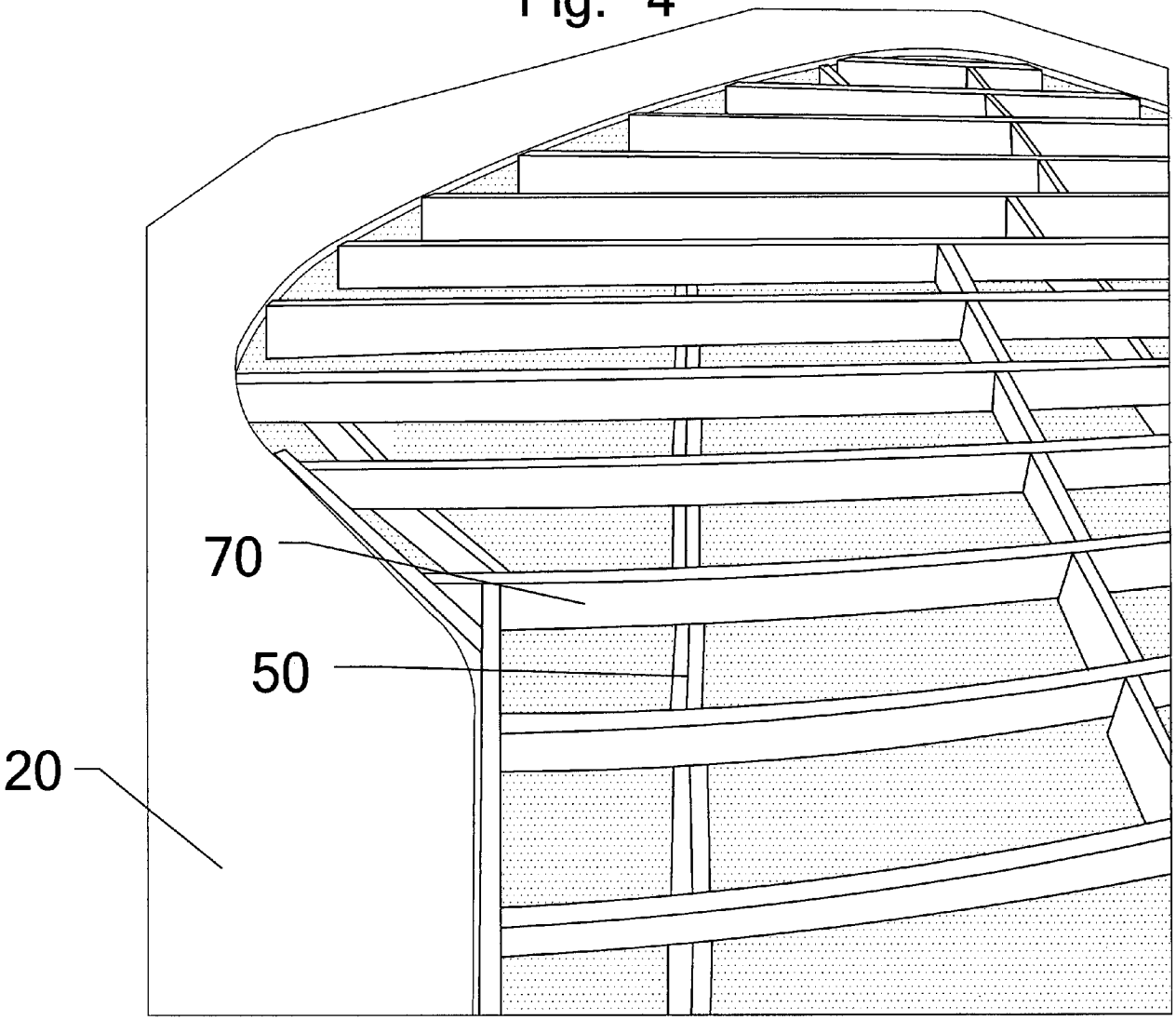
FIG. 4 is a perspective view of the deck being built to cover the swimming pool. In this view, cross members have been added.

FIG. 4 shows the joists 50 in place. Their locations are selected based on the lengths of the cross members 70 they bear. The horizontal joist 50 placement and distances between adjacent joists 50 are determined by well known calculations used in conventional floor and deck design. FIG. 4 also shows some of the cross members 70 in place in the emerging deck structure. These cross members 70 extend across the pool. Their depth is chosen based on conventional deck design in consideration of the weight of deck surface members 80 (discussed below) and other weight they are intended to support. To accommodate greater weights, the joists may be taller or closer together and the cross members also can be taller or closer together.

Figure 5:
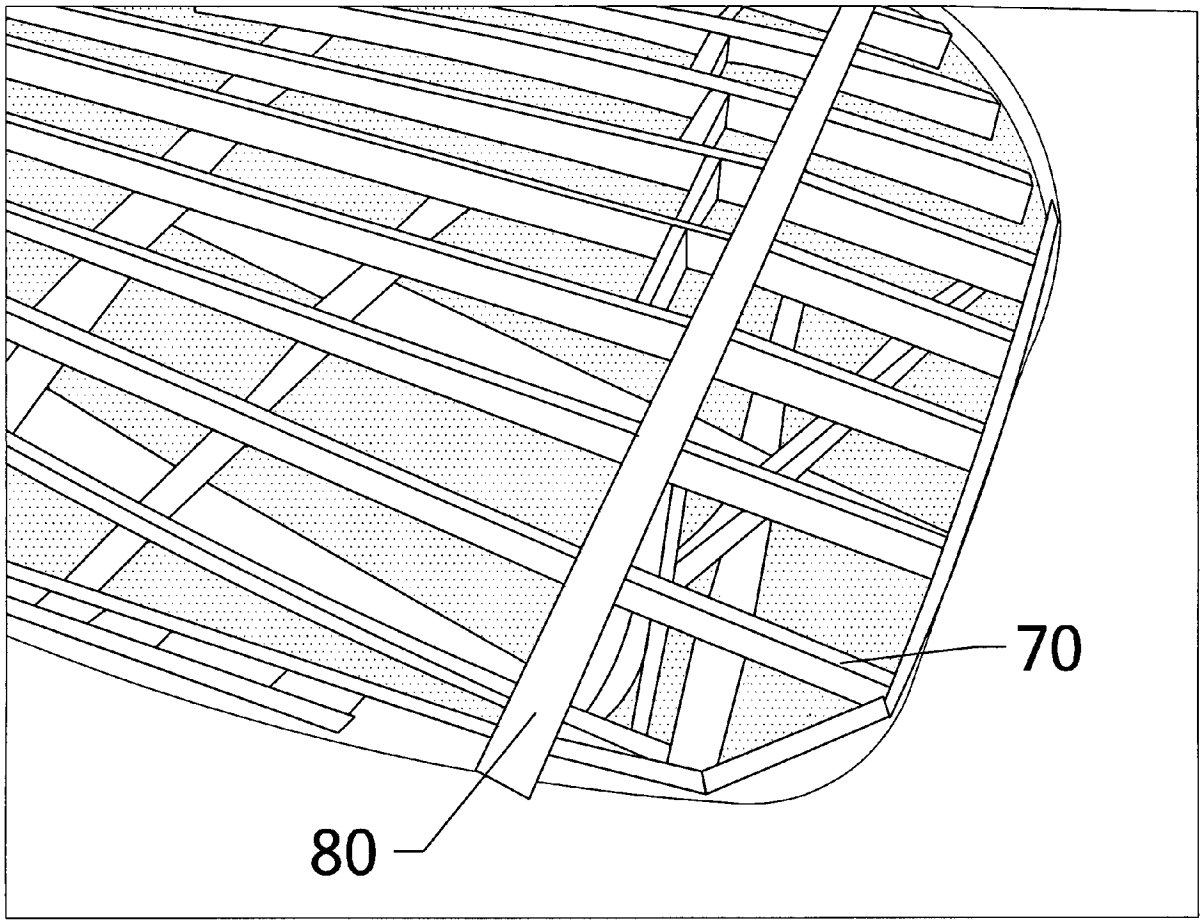
FIG. 5 is a perspective view showing the start of the deck surface with the placement of a deck surface member.
Figure 6:
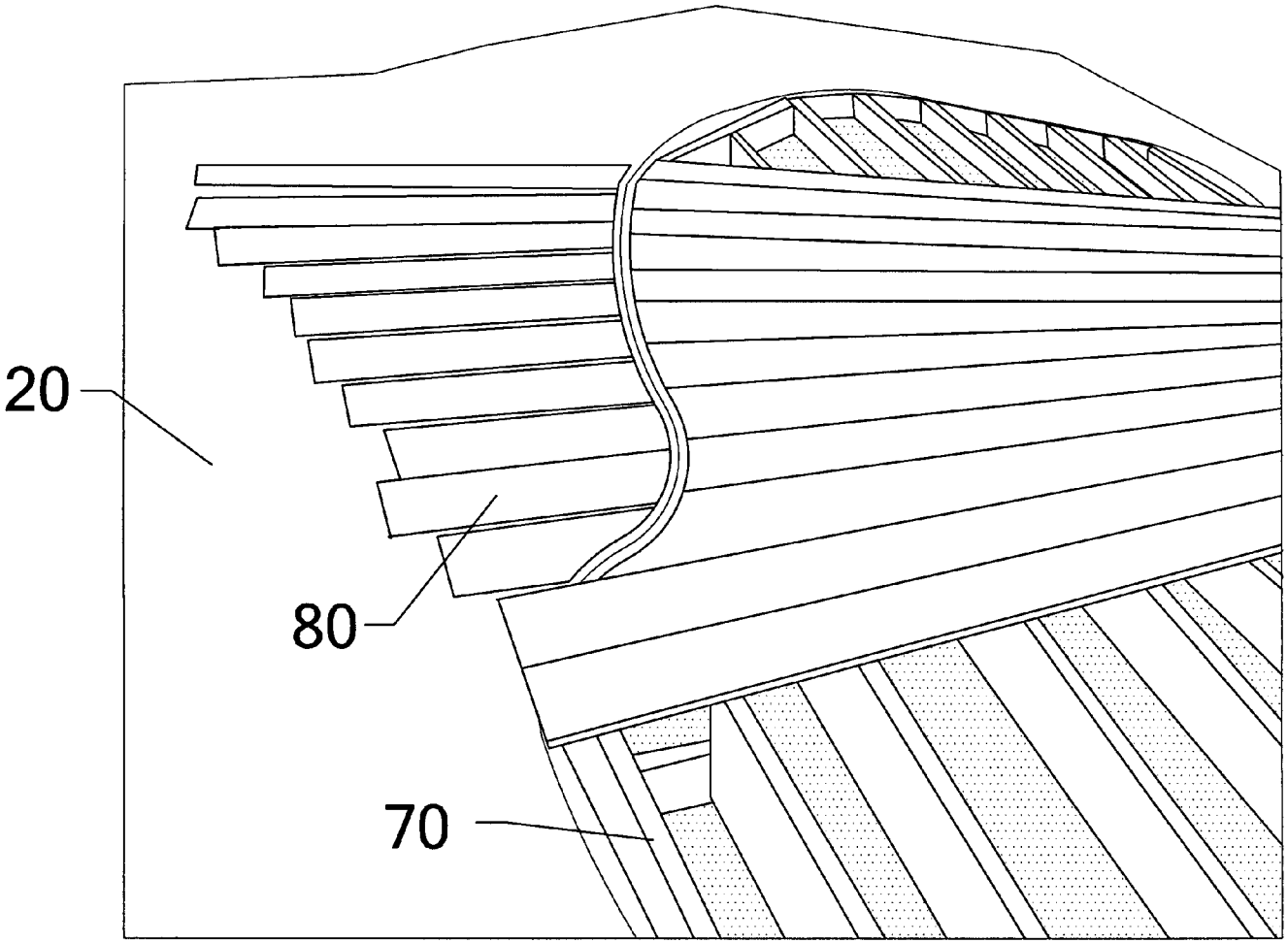
FIG. 6 is a perspective view of a partially built deck surface from which the excess lengths of board have been trimmed to fit into the free-form outline of the swimming pool.

FIG. 5 shows a deck surface member 80 placed on the cross members 70 to which it will be affixed with nails, screws or other such fasteners. FIG. 6 shows numerous deck surface members 80 on the cross members. In this embodiment, the deck surface members 80 are initially positioned above the concrete apron 20. At this height, it is easier to cut deck members 80 to accommodate the pool's outline.

Figure 7:
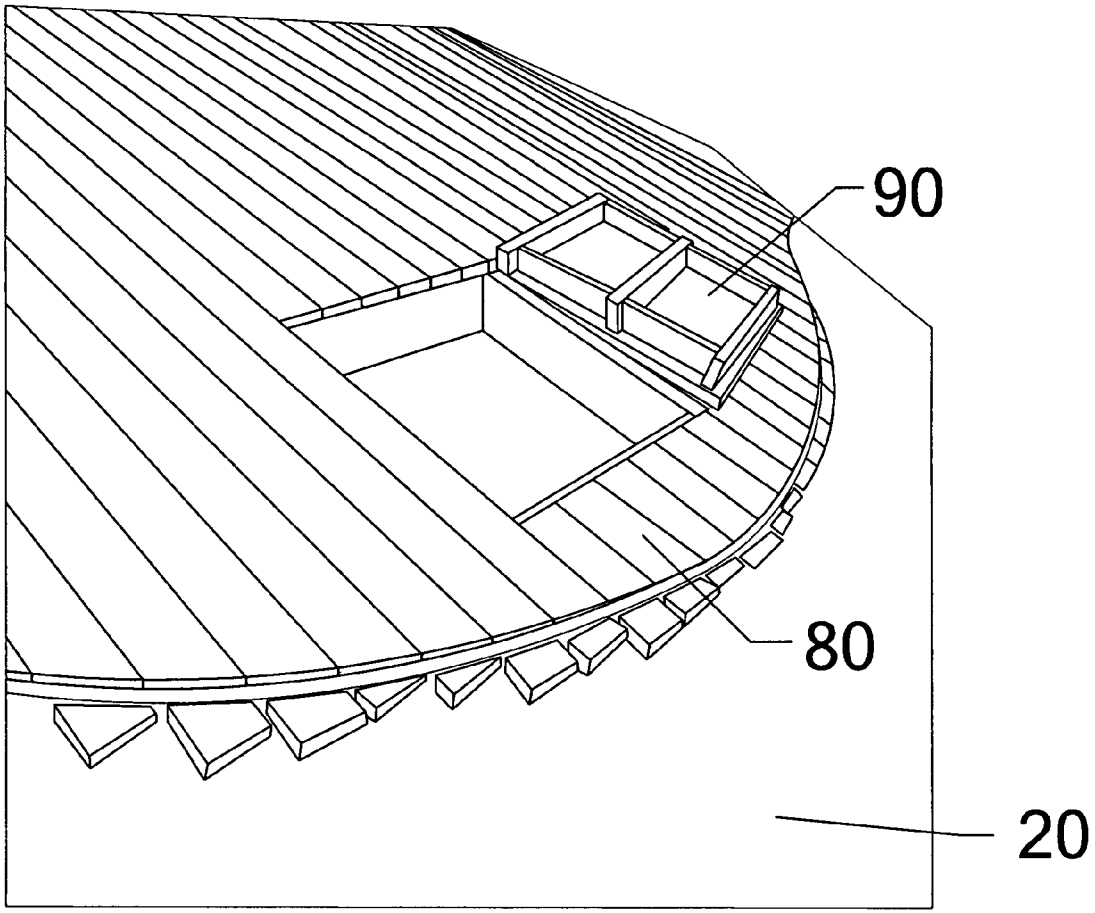
FIG. 7 is a perspective view of the deck surface with access door. The excess board lengths have been trimmed from the deck surface.

FIG. 7 shows an access door 90 to the area underneath pool deck. This enables access to the under-deck area for performing final steps of construction and allows access to maintenance of motor pump (not shown) that is required to keep pool empty of water.

Figure 8:
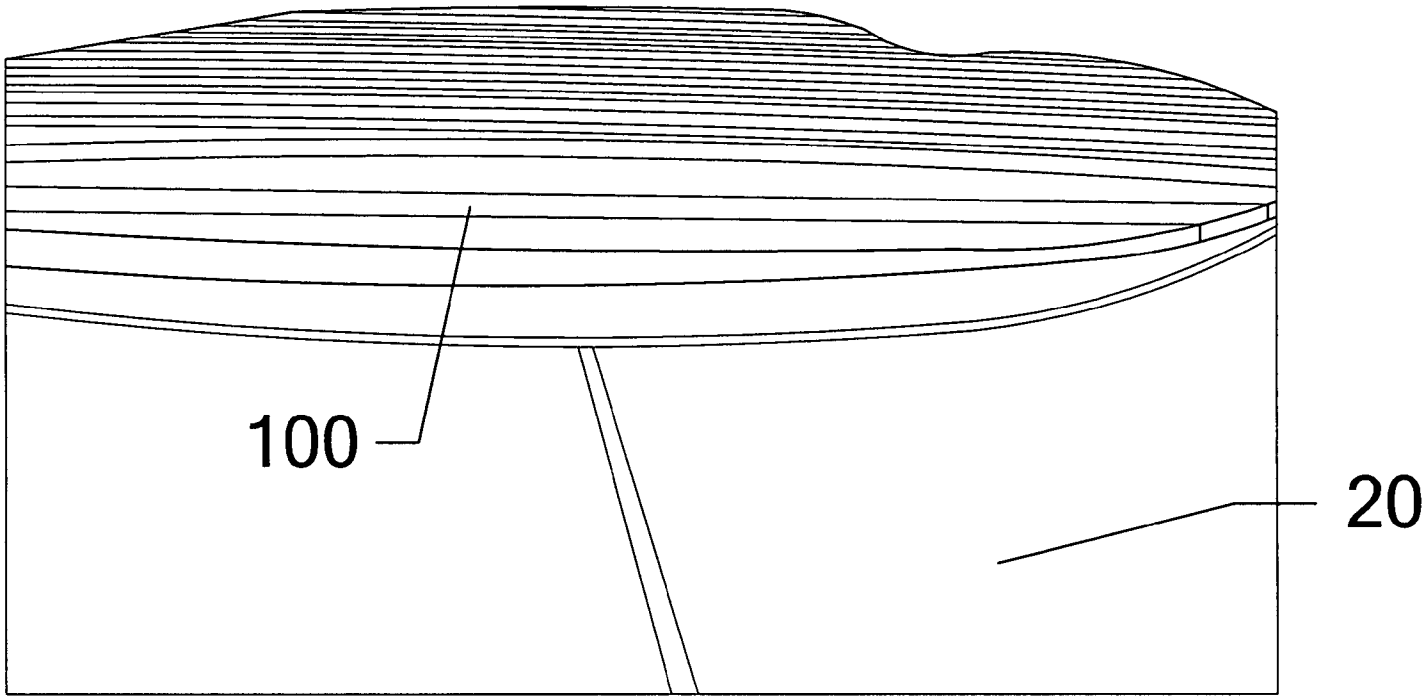
FIG. 8 is an end view of the completed deck surface before it is lowered to the level of the concrete apron around the swimming pool.

FIG. 8 is a side view of a completed deck 100, which is raised above concrete apron 20. The access door also allows entry of items to be stored, such as pool mechanicals, other outdoor equipment or water proof containers.

Figure 9:
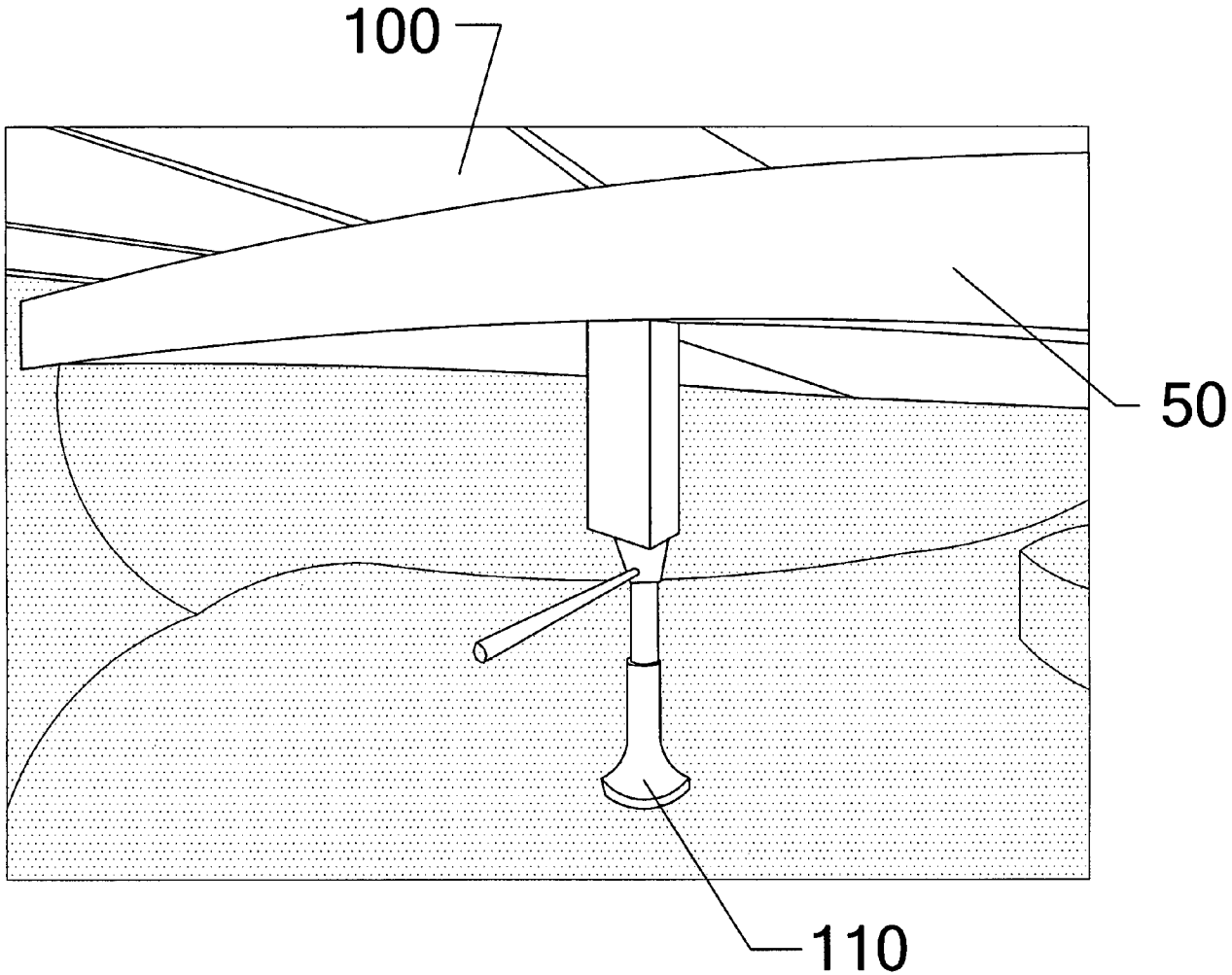
FIG. 9 is a perspective view below the deck structure, showing a jack that is used to raise the deck structure sufficiently to remove the blocks under the joists. The blocks raised up the deck structure for rapid removal of the board ends.

FIG. 9 provides a view under deck structure 100 accessed through door 90. A jack 110 has been placed to raise deck structure 100 a few inches to take pressure off joists 50 and allow removal of blocks 60*a*, 60*b*, shown in FIG. 2. Jack 110 then is used to lower the deck structure 100 level to that of the concrete apron 20.

Figure 10:
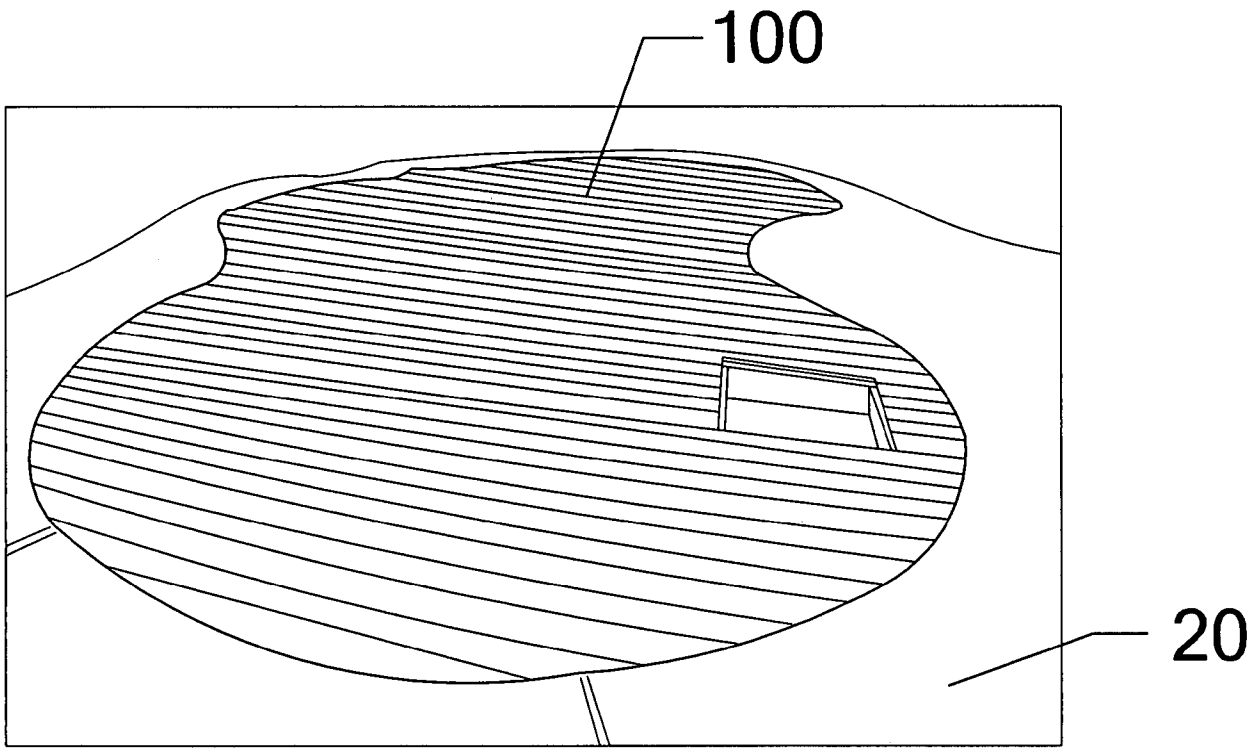
FIG. 10 is a perspective view of the finished deck structure with its deck surface flush with the surface of the pool apron. The access door is shown open to permit dropping in the pump that drains the pool.

FIG. 10 shows completed deck surface 100 flush with surrounding concrete apron 20. Also shown are the access door 90 and a pump 120. Through the access door 90, the pump 120 is lowered and placed at the lowest point of the pool to pump out water from rain or other sources.

When deck members were individually sized and then attached to the deck, these steps took approximately 3 days for a free-form pool measuring at the maximums 10 feet by 20 feet. When the new pool construction method (using shims and jacks to raise the structure) was invented and used, the construction time decreased to a little over one day. Not only was the time savings huge, but the overall appearance of the deck edge improved. Because the sizing of all the deck members was performed in a smooth, continuous motion, the adjacent deck members had more consistent and attractive blending of edge lines.

EXAMPLE 2

In this embodiment, a deck structure 100 is constructed as described above, including installing the joist hangers 40 below the decorative tile rim 30 of the pool. However, in this embodiment the joists 50 are placed directly into the hangers without shimming blocks 60. The rest of the joists are so installed. The cross members are installed the same. However, each deck surface member 80 is individually placed after it has been sized and sawed to the precise length needed at its location on the deck.

EXAMPLE 3

An additional improvement in the usefulness of the in-pool deck is a reinforced deck capable of accommodating a putting green. Particularly when the pool-using children no longer live at home do the parents' ideas tend to turn to golf. For both their own amusement and the amusement of visitors and to conserve water, people in the southern climates have begun to replace yard structures with artificial putting greens. This is a particularly attractive alternative since artificial grass has greatly improved in appearance and in imitation of a golf course.

Compared to the above examples, the following changes are contemplated to accommodate a putting green surface over the deck structure. First, the height of the beam hangers needs to be adjusted downward for the height of the overlying structure which may include but is not limited to the following: artificial turf, sand, gravel, crushed granite, a sand impermeable surface, and any height due to reinforcing the structure. The structure may have a plywood floor to create a surface that allows the soil to be supported. Furthermore, additional beam hangers may be needed to accommodate the weight. Moreover, the beam hangers may need to be installed with longer bolts that sink deeper into the pool sides. Additional substructure may be required, such as posts, footings or other structures on or in the pool floor. The deck structure may include some water proofing and a built in slope to allow water to run off to the side.

On top of the reinforced pool deck surface is placed a mesh to prevent sand from flowing into the pool and disrupting the putting green structure. The mesh permits water to pass through the surface and the deck. On top of the mesh is placed gravel to provide the general contouring for the putting green. On top of the gravel is placed sand to fine-tune the contour. Finally, holes are formed and lined in the surface. Lastly, the artificial grass is laid down. More than one type of artificial grass can be used to give the appearance of a green with surrounding rough or taller grass.

In another embodiment, there are provided the following layers of deck structure and overlying turf:

1. Vertical posts rest on pool floor and support cross beams.
2. Cross beams span the width of the pool and hang in side hangers. With the infinitely unique shapes of this type of a pool, the cross beams will most likely not be parallel to each other or perpendicular to the side walls.
3. Floor joists rest on the cross beams and run generally the opposite direction as the cross beams.
4. Plywood is placed on top of the floor joists.
5. A waterproof membrane applied to the plywood.
6. Mesh is place at drainage locations to allow water to exit, yet hold in the soil or materials that create the effect of soil under the turf.
7. Artificial turf layers cover the top deck and include, but are not limited to, gravel, sand and artificial grass.

Decks are made from treated lumber, composite material, Aluminum, Western red cedar, teak, mahogany, and other hardwoods and recycled planks made from high-density polyethylene (HDPE), polystyrene (PS) and PET plastic as well as mixed plastics and wood fiber (often called "composite" lumber).

A variety of braces, brackets and hangers can be used to support and form the deck structure. For example the bracket that is bolted to the pool wall can be a conventional joist hanger or other conventional bracket used in the industry.

Figure 11:
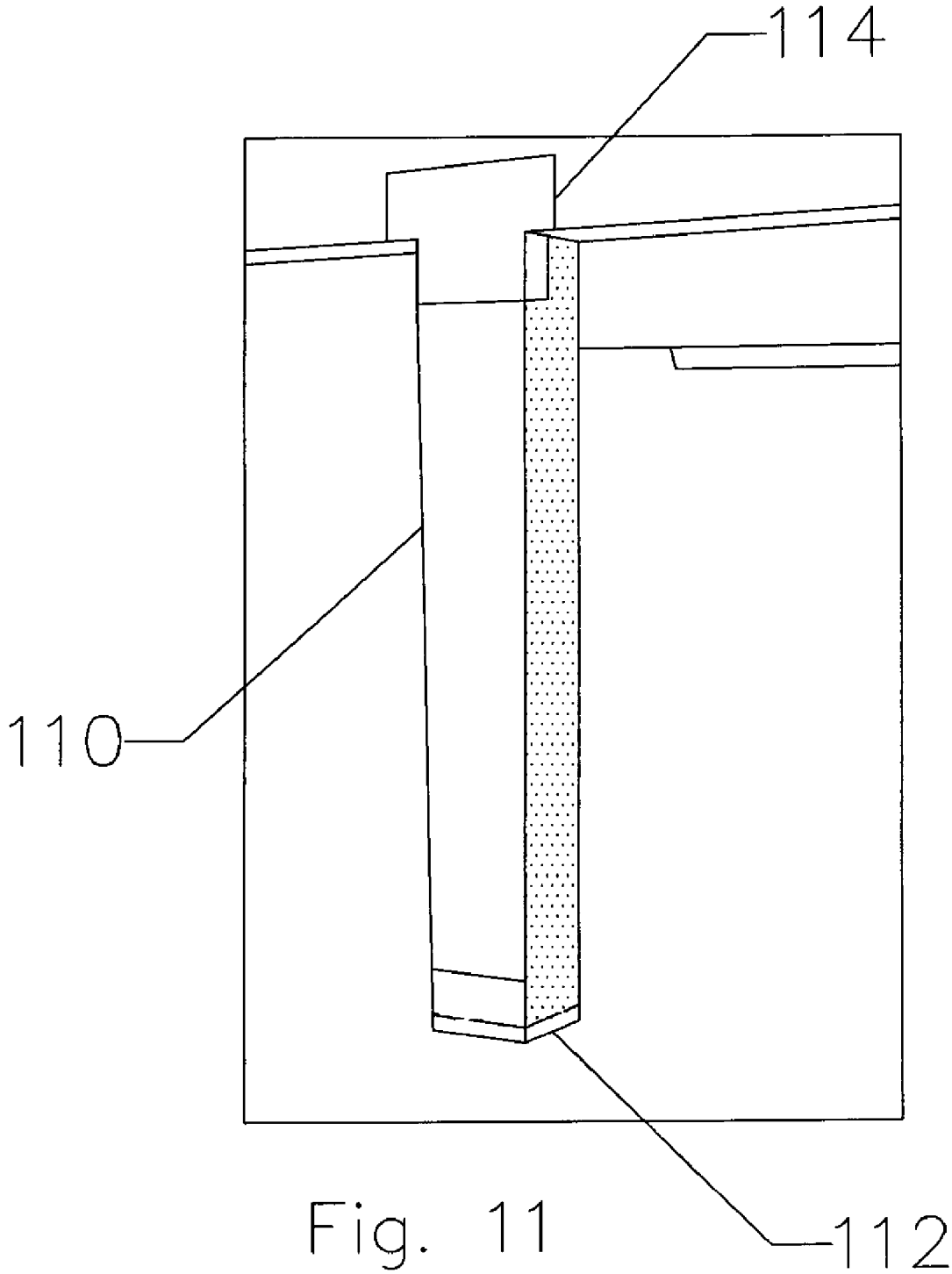
FIG. 11 is a perspective view of a vertical post connected to a pool floor and to a cross beam in a pool covering structure in accordance with the present invention.
Figure 12:
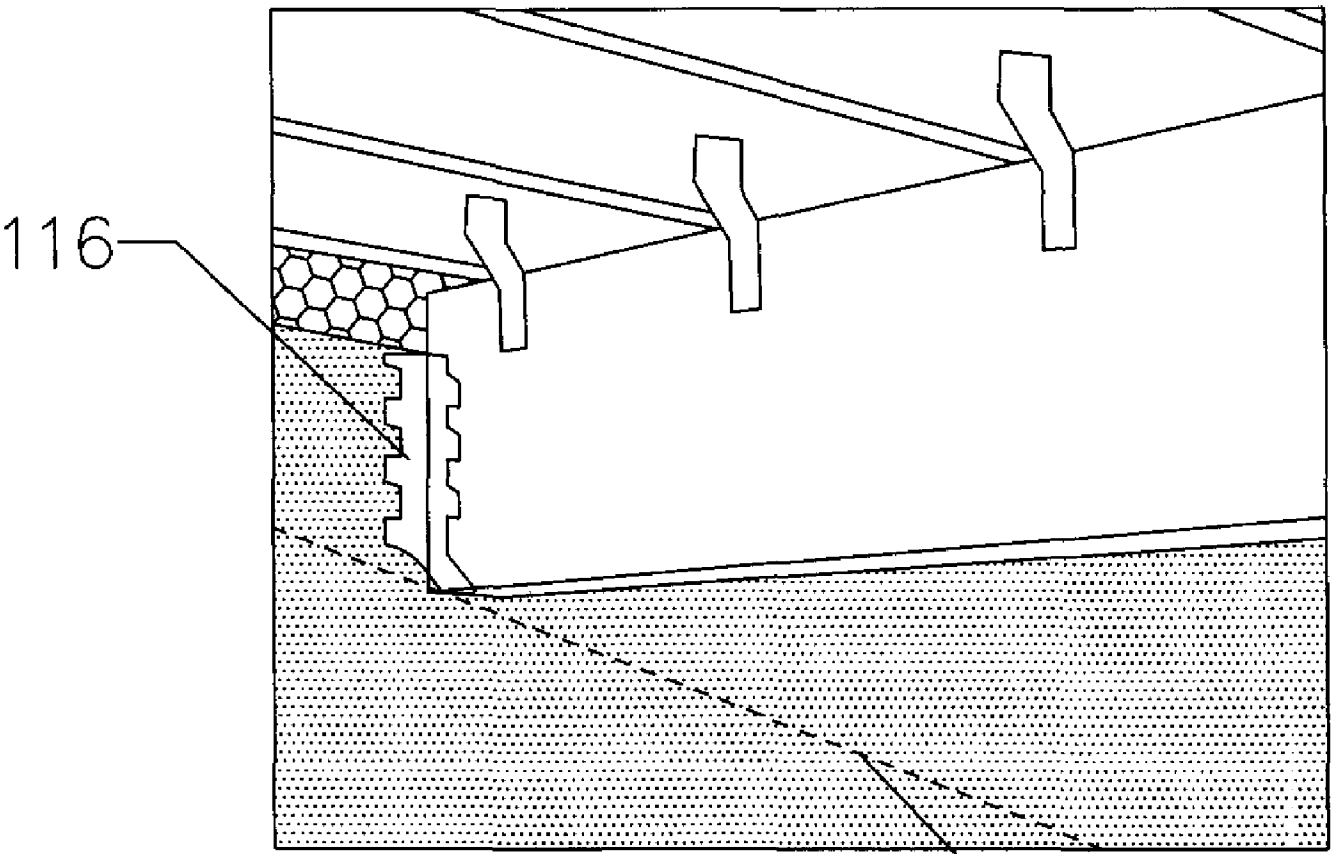
FIG. 12 is a perspective view of a beam resting in a beam mount which is placed on a pool floor portion of a pool seat or pool step in a pool covering structure in accordance with the present invention.

FIG. 11 is a perspective view of a vertical post 110 connected to a pool floor and to a cross beam in a pool covering structure in accordance with the present invention where cross members rest on a beam or joist which is of sufficient length to require support from beneath at one or more locations between the ends of the beam or joist. A metal connector foot 112 is shown utilizing a bolt with a lag (not visible in the figure) into the plaster and concrete pool floor to connect the vertical post to the pool floor. A metal upper connector 114 fastens the upper end of the vertical post to the beam or joist. FIG. 12 is a perspective view of a beam resting in a beam mount 1116 which is placed on a pool floor portion of a pool seat or pool step 118 (emphasized in the drawing figure with a dotted line) in a pool covering structure in accordance with the present invention where a pre-existing pool step or pool seat has been formed as part of the pool and is at a correct height to accommodate a beam and a beam mount. Where this approach to supporting a beam is used, the beam mount includes pressure treated wood to rest on the pool floor and then the beam rests on the pressure treated wood. The beam is held in place by the rigidity of the structure held together on the top of the beam. In an embodiment in accordance with the present invention, the top of the cross beam holds a tapered shim to give the proper crown and angle to the floor joists.

Figure 13:
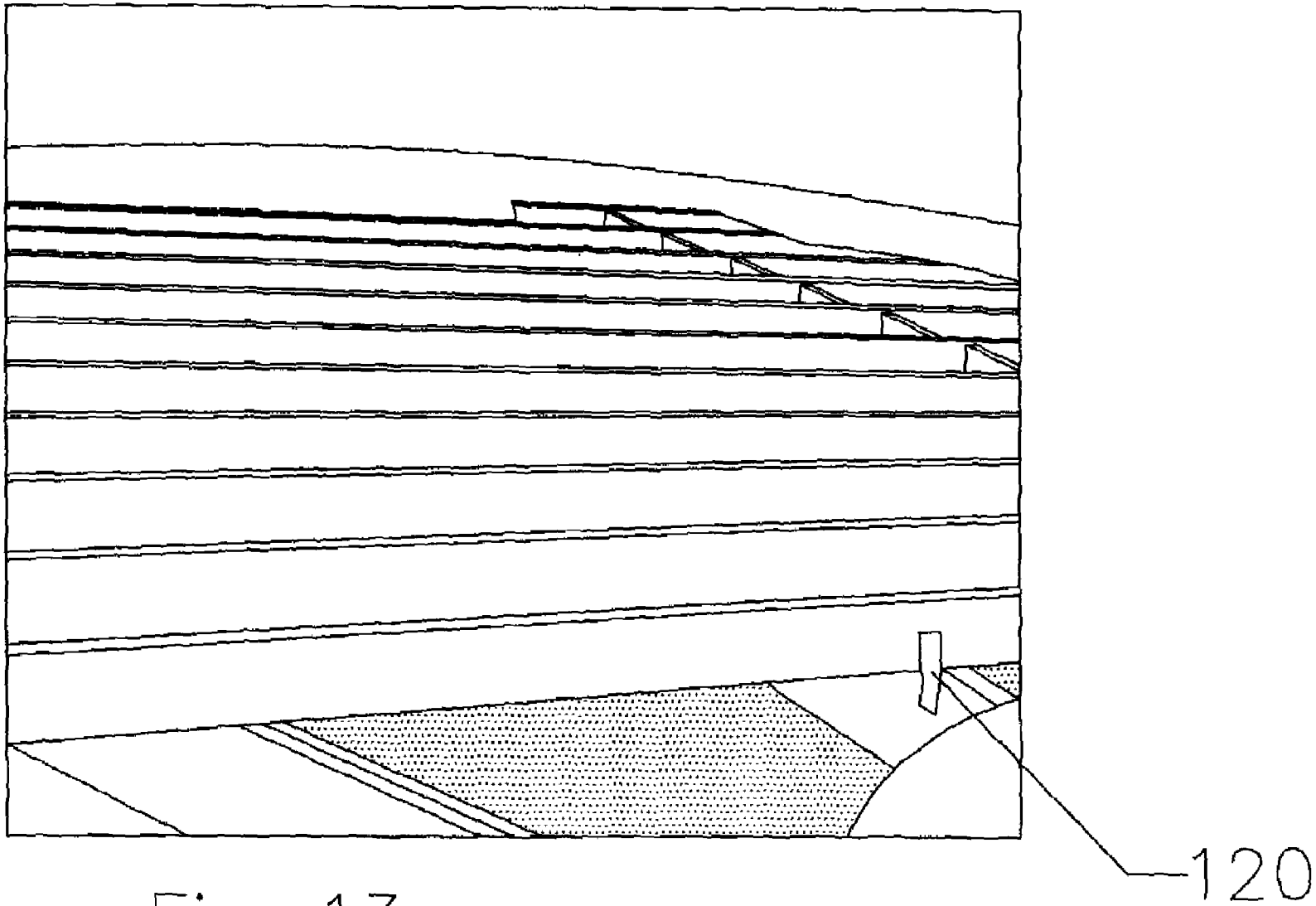
FIG. 13 is a perspective view of metal connectors connecting floor joists to a cross beam in a pool covering structure in accordance with the present invention.

FIG. 13 is a perspective view of a metal connector 120 connecting floor joist to a cross beam in a pool covering structure in accordance with the present invention. The floor joists rest on top of the cross beams and are fastened by metal connectors. The metal connectors are used on each end of the floor joist and sometimes on a middle beam if the floor joists are of sufficient length to require same.

In accordance with an exemplary embodiment of a pool covering structure in accordance with the present invention, a layer of ¾" tongue and grooved exterior grade plywood is placed over the floor joists and screwed or nailed down. The plywood is placed overlapping the edge of the pool and then carefully cut to fit the shape of the pool. Holes may be cut to accommodate grates, referenced below, which will allow ventilation. A waterproof membrane is placed on top of the plywood and wrinkles removed from the waterproof membrane. The waterproof membrane is typically a one piece sheet of EPDM rubber, or PPL plastic sheet. There may be joints in the waterproof membrane in order to form a single sheet by joining smaller sheets, in which case the seams are glued. A fabric or wire reinforcement is optionally added to the waterproof membrane.

To provide ventilation, is required by building codes for enclosed spaces, either of two types of ventilation are usable. One type of ventilation employs a grate with a screen mesh placed throughout the surface by framing in the open locations throughout the floor and allowing the membrane to cover the frame perimeter. Another type of ventilation is provided when approximately ¼ to ⅓ of the area is formed as a deck of planks as in a regular deck. The spacing between planks may be set at the maximum amount allowed by the deck plank manufacturer to maximize ventilation for a given deck area. The exemplary pool covering including a deck has a section that is solid and covered in one of several materials as detailed below, and another section which is a traditional deck with deck planks.

In accordance with the present invention, the pool covering structure may be finished in any of a variety of top covers, in addition to the crushed granite already mentioned above.

More particularly, in accordance with the present invention, a pool covering structure is provided with a variety of final surface coverings which are similar to one another in the structural support they utilize and which may require a variation in the final height of the plywood layer to which they are applied, so that the overall finished height matches the sides of the swimming pool.

In one embodiment, a putting green or other turf application is disposed on the previously described layer of plywood. An example of such a product is "Forever Lawn Select LX" brand of turf grass product, available at http://www.foreverlawnarizona.com/LX.html. Other brands and variations could also work in this situation. The turf is placed and cut to size, then stapled or nailed down to the floor. This particular material has a built-in pad which helps cushion the hardness of the floor surface. If this brand is not used, a separate pad may be used under the turf in addition to the layer of turf to provide a cushion. On top of the grass a mixture of special sand and rubber is spread into and mixed into the grass fibers. Additionally, different combinations of putting green grass can be mixed in with the turf listed above. The putting green material is shorter in height, thus allowing the golf ball to roll smoothly. Putting green cups may be placed throughout the deck to provide a challenging choice of putting paths. The turf can also be carried over the edge of the pool covered deck and appear as a continuous extension of the turf, completely hiding the location of the pool.

In another exemplary embodiment, a putting green is provided on putting green panels. This option is used where a precise putting green is needed. The plywood floor and membrane are the same as other configurations, but the elevation is lowered to accommodate the thickness of the panels. The manufacturer of the panels chosen for this option is "Tour Links" brand, whose website is found at www.tourlinks.net/custom/specs_panels.html. A variety of turfs and putting greens may be used and placed across the deck top with putting green cups and contours to give a challenging choice of putting paths. The contours used would be by the same manufacturer of the putting green panels. This is shown on the web page http://www.tourlinks.net/custom/access_contours.html. The turf may also be carried over the edge of the pool covered deck and appear as a continuous extension of the turf, completely hiding the location of the pool.

Another exemplary embodiment finishes the pool covering structure as an acrylic deck which is used whenever the final deck surface is desired to imitate a stone or concrete textured surface. The beauty of this product is that it can look exactly like the surrounding surfaces that are placed around the existing pool. It can also bide the existing pool. The manufacturers spec sheet is found on a website at http://westcoat.com/downloads/ALX_Standard_Spec_Sheet.pdf. The available textures and colors are available in a wide range of variety.

Another exemplary embodiment finishes the pool covering structure in a rubber playground cover, appropriate where a safe playground surface is needed. A swing set or other playground type equipment may be placed upon the deck creating a safe area where children may tumble and play.

Another exemplary embodiment finishes the pool covering structure as a sport deck similar to the rubber playground. The sport deck is placed down in 12" squares that link together and are fastened down throughout the surface. This deck provides a surface for balls to bounce on without erratic deflections.

In another exemplary embodiment of a pool covering structure in accordance with the present invention, a staged installation option is provided to a customer. A first finished installation, which may be, for example, a sport covering having a thickness of ¾ inch, is provided upon a pool covering structure which, by the end of the first finished installation, is positioned with the aid of one or more shims at a height such that the final overall height of the sport covering matches the customer's preference relative to the height of the edge of the pool or the height of the apron. At a later time, at the customer's instance, a second finished installation is provided in which a contoured putting green is provided on top of or as a replacement for the sport covering of the first finished installation. Where the contoured putting green is thicker than the sport covering, the final height of the second finished installation will be equal to that of the first finished installation only if the structure supporting the green is lowered. This is accomplished by removing or replacing one or more of the shims that were left in place in the first finished installation. Jacking may be required in this process. Alternatively, plywood layers of different thicknesses may be provided to accommodate subsequent variations in final surface thickness.

Although specific embodiments have been illustrated and described herein, those of ordinary skill in the art will appreciate that any arrangement calculated to achieve the same purpose can be substituted for the specific embodiments shown. This disclosure is intended to cover any and all adaptations or variations of various embodiments of the invention. It is to be understood that the above description has been made in an illustrative fashion, and not a restrictive one. Combinations of the above embodiments, and other embodiments not specifically described herein will be apparent to those of skill in the art upon reviewing the above description. The scope of various embodiments of the invention includes any other applications in which the above structures and methods are used. Therefore, the scope of various embodiments of the invention should be determined with reference to the appended claims, along with the full range of equivalents to which such claims are entitled.

It is emphasized that the Abstract is provided to comply with 37 C.F.R §1.72(b) requiring an Abstract that will allow the reader to quickly ascertain the nature and gist of the technical disclosure. It is submitted with the understanding that it will not be used to interpret or limit the scope or meaning of the claims.

In the foregoing Detailed Description, various features are grouped together in a single embodiment for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the Description of Embodiments of the Invention, with each claim standing on its own as a separate preferred embodiment.

The invention claimed is:

1. A putting green over a conventional in-ground pool, the combination comprising a) a concrete-sided pool having a decorative ribbon along the top of the pool side and a concrete apron surrounding the pool, the apron having at least a partially flat surface;

b) a surface comprising decking surface members having lengths and ends, the lengths adapted to be the dimensions of the pool;

c) supports comprising i. cross members which are perpendicular to the lengths of the decking surface members;

ii. underlying joists that form a sturdy base for the cross members; and iii. joist hangers being secured to the sides of the pool below the decorative ribbon and near the top of the pool side and being sunk into sides of the concrete side of the pool; and d) a putting green adapted to the size of the pool and comprising at least the layers of gravel and artificial grass.

* * * * *